US005692465A

United States Patent [19]

Sawada et al.

[11] Patent Number: 5,692,465

[45] Date of Patent: Dec. 2, 1997

[54] VALVE OPERATING APPARATUS

[75] Inventors: Takanori Sawada, Atsugi; Shoji Morita, Aikawa; Makoto Kano, Yokohama; Shinichi Takemura; Atsushi Ehira, both of Fujisawa, all of Japan

[73] Assignees: Nissan Motor Co., Ltd.; Unisia Jecs Corporation, both of Kanawaga, Japan

[21] Appl. No.: 732,679

[22] Filed: Oct. 16, 1996

[30] Foreign Application Priority Data

Oct. 17, 1995 [JP] Japan ..... 7-268823

[51] Int. Cl.[6] ..... F01L 13/00; F01L 1/18

[52] U.S. Cl. ..... 123/90.16; 123/90.39; 123/90.51

[58] Field of Search ..... 123/90.15, 90.16, 123/90.17, 90.27, 90.39, 90.44, 90.51

[56] References Cited

U.S. PATENT DOCUMENTS

| | | | |
|---|---|---|---|
| 4,476,824 | 10/1984 | Reinke et al. | 123/90.39 |
| 4,485,770 | 12/1984 | Saka et al. | 123/90.39 |
| 4,870,931 | 10/1989 | Nakamura et al. | 123/90.39 |
| 4,873,150 | 10/1989 | Doi et al. | 123/90.39 |
| 5,195,473 | 3/1993 | Kano et al. | 123/90.39 |
| 5,445,116 | 8/1995 | Hara | 123/90.16 |
| 5,452,694 | 9/1995 | Hara | 123/90.16 |

FOREIGN PATENT DOCUMENTS 64-49602 3/1989 Japan .

*Primary Examiner*—Weilun Lo

*Attorney, Agent, or Firm*—Lowe, Price, LeBlanc & Becker

[57] ABSTRACT

A main rocker arm is supported for swinging motion to operate one of the intake and exhaust valves of an internal combustion engine. A high-speed rocker arm is supported on the main rocker arm for swinging motion according to rotation of a high-speed cam rotating in synchronism with engine rotation. The high-speed rocker arm has a slip surface for engagement with the high-speed cam. The high-speed rocker arm is drivingly connected to the main rocker arm for swinging motion in unison with the main rocker arm when the engine is operating at a high speed. The driving connection is released to permit swinging motion of the main rocker arm according to rotation of a low-speed cam independently of the swinging motion of the high-speed rocker arm when the engine is operating at a low speed. The slip surface of the high-speed rocker arm is made of an alloy tool steel having carbide deposited and dispersed to provide a hardness of HRC55 or more to the slip surface. A hard coat is formed through physical vapor deposition on the slip surface of the high-speed rocker arm.

7 Claims, 1 Drawing Sheet

VALVE OPERATING APPARATUS

BACKGROUND OF THE INVENTION

This invention relates to an apparatus for operating at least one of intake and exhaust valves of an internal combustion engine with valve lift characteristics different when the engine is operating at a low speed than when the engine is operating at a high speed.

For example, Japanese Utility Model Kokai No. 64-49602 discloses a conventional valve operating apparatus for use with an automotive vehicle engine. The valve operating apparatus includes a rocker arm having a cam slip surface for sliding contact with a cam. The cam slip surface has a sintered metal chip soldered thereon. One of the problems associated with such a conventional valve operating apparatus is that the cam slip surface has an increased thickness resulting in a space consuming apparatus. Furthermore, the cam slip surface exhibits poor strength because of fatigue cranking produced along the grooves formed for positioning the chip and it is softened to provide poor wear resistance because of exposure to increased temperatures during soldering.

SUMMARY OF THE INVENTION

It is a main object of the invention to provide a compact valve operating apparatus which exhibits an excellent strength endurable for great loads applied when the engine is operating at a high speed and an excellent wear resistance endurable for great surface pressures of 600 MPa or more.

There is provided, in accordance with the invention, a valve operating apparatus for use with an internal combustion engine including at least one cylinder having at least one intake valve and at least one exhaust valve, and a camshaft rotatable in synchronism with rotation of the engine. The valve operating apparatus comprises a high-speed cam mounted on the camshaft for rotation in unison with the camshaft, a low-speed cam mounted on the camshaft for rotation in unison with the camshaft, a main rocker arm supported for swinging motion to operate one of the intake and exhaust valves, and a high-speed rocker arm having a slip surface for engagement with the high-speed cam. The high-speed rocker arm is supported on the main rocker arm for swinging motion according to rotation of the high-speed cam. The valve operating apparatus also includes means for making a driving connection of the high-speed rocker arm to the main rocker arm for swinging motion of the main rocker arm in unison with the high-speed rocker arm when the engine is operating at a high speed, and means for interrupting the driving connection of the high-speed rocker arm to the main rocker arm to permit swinging motion of the main rocker arm according to rotation of the low-speed cam independently of the swinging motion of the high-speed rocker arm when the engine is operating at a low speed. The slip surface of the high-speed rocker arm is made of an alloy tool steel having carbide deposited and dispersed to provide a hardness of HRC55 or more to the slip surface. A hard coat is formed, through physical vapor deposition, on the slip surface of the high-speed rocker arm.

The valve operating apparatus of the invention exhibits an excellent strength endurable for great loads applied when the engine is operating at a high speed even though the high-speed rocker arm is formed therein with a recess for receipt of a lost motion mechanism. Furthermore, the high-speed rocker arm exhibits an excellent wear resistance endurable for high surface pressures greater than 600 MPa.

Preferably, a lost motion mechanism is placed in the high-speed rocker arm for lost motion of the high-speed rocker arm when the engine is operating at a low speed. This results in a compact and light valve operating apparatus.

Preferably, the alloy tool steel is one of draw steel SKD and high-speed tool steel SKH. This is effective to provide a great softening resistance so as to avoid any decrease in the hardness of the fundamental member below the hard coat from when exposed to high temperatures during physical vapor deposition. It is, therefore, possible to prevent the fundamental member from sinking below the hard coat.

Preferably, at least one of CrN, $Cr_2N$ and TiN is deposited, through physical vapor deposition, to form the hard coat having a thickness ranging from 2 μm to 7 μm and a Vickers Knoop hardness greater than Hk1500. This is effective to provide a great degree of wear resistance to the cam slip surface of the high-speed rocker arm.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 1:
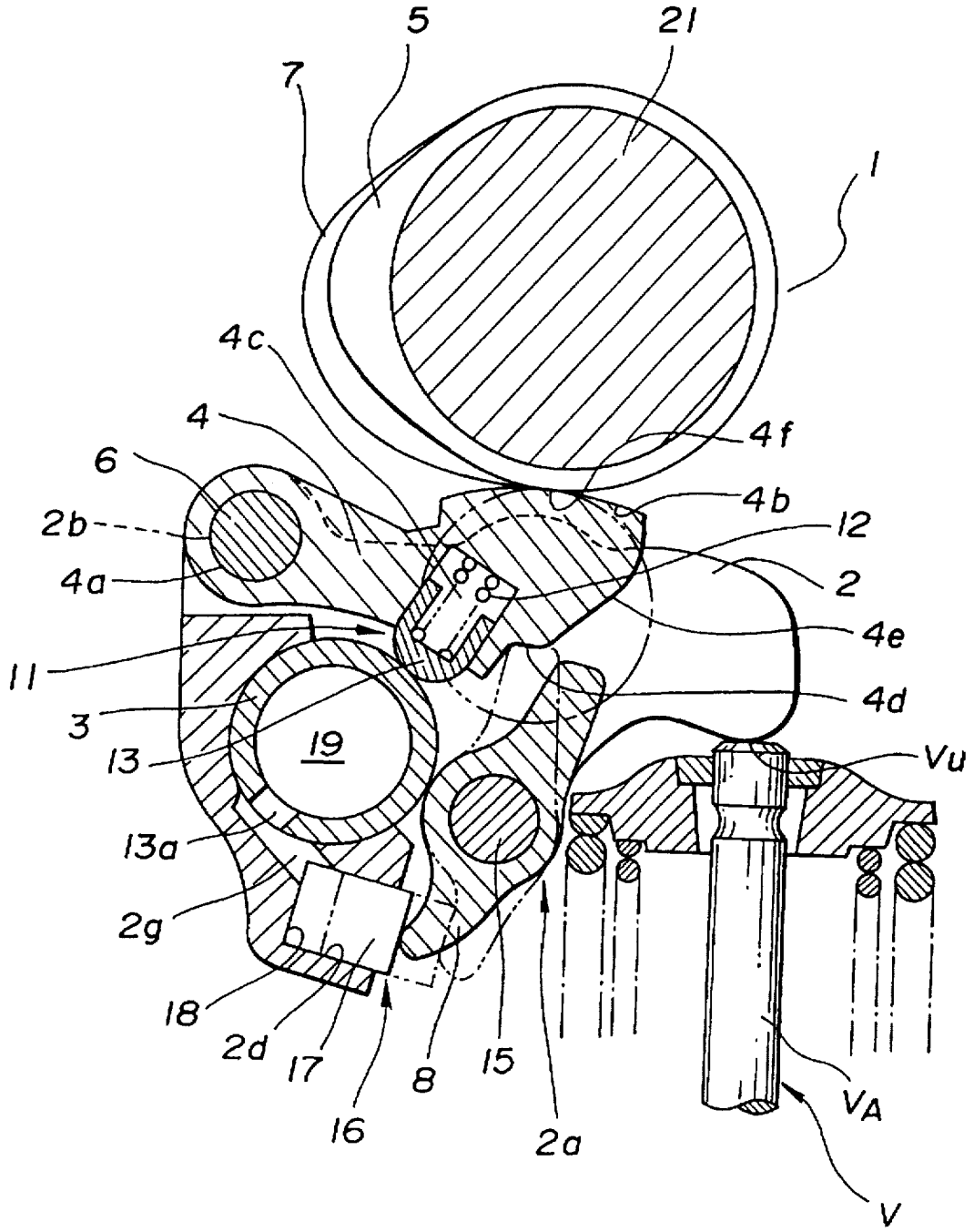
FIG. 1 is a schematic diagram showing a significant portion of a valve operating apparatus embodying the invention.

With reference to FIG. 1, there is shown one embodiment of a valve operating apparatus made in accordance with the invention. The valve operating apparatus, generally designated at the numeral 1, is shown as used with an internal combustion engine of the type having a pair of intake valves for regulation of the entry of combustion ingredients into each of the cylinders from the intake manifold and a pair of exhaust valves for regulation of the exit of combustion produces, exhaust gases, from each of the cylinders into the exhaust manifold. However, it is to be understood, of course, that the invention is equally applicable to other types of engine having at least one intake valve and at least one exhaust valve. Although the invention will be described in connection with a rocker arm for operating the intake valves, it is to be understood, of course, that the invention is equally applicable to operate the exhaust valves. Each of the intake valves, one of which is shown at V, has a valve stem $V_A$ terminating at its front end in a valve body of the intake valve V.

The valve operating apparatus 1 includes a main rocker arm 2 supported on a hollow main rocker shaft 3 for swinging motion with respect to the engine cylinder head. The main rocker arm 2 is cut to form a space **2*a* defined between two forked walls positioned for abutment with the rear ends $V_U$ of the respective valve stems $V_A$ of the intake valves V. In the illustrated case, the main rocker arm 2 is cut to such an extent that the main rocker shaft 3 is partially exposed to the space. This is effective to shorten the distance between the main rocker shaft 3 and the valve stems $V_A$ so as to realize a compact main rocker arm 2. Each of the forked walls has a shaft hole 2*b* formed near the rear ends thereof. A high-speed rocker arm (free cam follower) 4 is placed between the forked walls. The high-speed rocker arm 4 is secured on a sub rocker shaft 6 extending through a shaft hole 4*a* formed in the high-speed rocker arm 4 near the rear end thereof. The opposite ends of the sub rocker shaft 6 are fixedly fitted in the respective shaft holes 2*b*. The high-speed rocker arm 4 has a convex cam follower 4*b* provided with a cam slip surface 4*f* facing upward for sliding contact with a high-speed cam 7 mounted on a cam shaft 21. Two rollers are positioned on the opposite sides of the high-speed rocker arm 4 for engagement with respective low-speed cams 5 mounted on the cam shaft 21. The rollers are carried for rotation through needle bearings on the bearing shafts fitted in the through-holes formed in the respective main rocker arms 2. The high-speed rocker arm 4 is formed in its lower surface with a cylindrical recess 4***c* which contains a lost motion mechanism 11. The lost motion mechanism 11 includes a cap-shaped spring retainer 13 placed for sliding movement in the cylindrical recess 4*c* and a coil spring 12 located in the cylindrical recess 4*c* for urging the spring retainer 12 into resilient contact with the main rocker shaft 3. The high-speed rocker arm 4 is formed in its lower surface at a position corresponding to the cam follower 4*b* with a stepped portion 4*d* for engagement with a lever 8 mounted on a pin 15 for rotation within the space 2*a*. The high-speed rocker arm 4 is formed with an inclined surface portion 4*e* continued to the stepped portion 4*d*.

The lever 8 is formed near its upper end with a projection for engagement with a spring retainer placed for sliding movement in a cylindrical recess formed in the main rocker arm 2. A return spring is located in the cylindrical recess to urge the spring retainer in such a direction as to place the lever 8 at a first position, indicated by the solid lines, where the lever 8 is disengaged from the high-speed rocker arm 4. The lever 8 is also associated with a hydraulic driver 16 which includes a plunger 17 placed for sliding movement in a cylindrical recess 2*d* formed in the main rocker arm 2. An oil chamber 18, which is defined in the cylindrical recess on the rear side of the plunger 17, is connected through an oil passage 2*g* extending through the main rocker arm 2 to a port 3*a* formed in the hollow main rocker shaft 3. The hollow main rocker shaft 3 has an oil gallery 19 opening into the oil passage 2*g* through the port 3*a*. The oil gallery 19 is connected through a change-over valve to an oil pump. When the change-over valve opens to introduce a hydraulic pressure into the oil chamber in a predetermined high engine speed range, the plunger 17 extracts to rotate the lever 8 in the counter-clockwise direction, as viewed in FIG. 1, from a first position indicated by the solid line of FIG. 1 to a second position indicated by the broken lines of FIG. 1, to cause the projection to slide the inclined surface 4*e* into engagement with the stepped portion 4*d* against the resilient force of the return spring.

A control unit operates the change-over valve to make a change between the valve lift characteristics different when the engine is operating at a low speed than when the engine is operating at a high speed based on engine operating conditions that are sensed during engine operation to ensure smooth valve lift characteristic changes with almost no sudden engine torque changes. These engine operating conditions include engine speed, engine coolant temperature, lubrication oil temperature, throttle valve position, etc. The low-speed cams 5 have such a profile as to provide a valve lift characteristic required for low engine speeds. The high-speed cam 7 has such a profile as to provide a valve lift characteristic required for high engine speeds. That is, the high-speed cam 7 has a profile designed to provide a greater valve lift and/or valve duration than the low-speed cams 5. In the illustrated case, the profile of the high-speed cam 7 is designed to have a greater valve lift and a greater valve duration than that of the low-speed cams 5. When the engine is operating at a low speed, the main rocker arm 2 swings according to the profile of the low-speed cams 5 to open and close the intake (or exhaust) valves V. In this case, the high-speed rocker arm 4 also swings according to the profile of the high-speed cam 7. Since the lever 8 is retained in the first position, as indicated by the solid lines, under the resilient force of the return spring, however, the lost motion mechanism 11 operates to permit the main rocker arm 2 to swing independent of the movement of the high-speed rocker arm 4. Thus, the intake (or exhaust) valves V operate to open and close according to the profile of the low-speed cams 5.

When the engine is operating at a high speed, a working oil is introduced through the oil passage 2*g* into the oil chamber 18, causing the plunger 17 to push the lever 8 in the counter-clockwise direction against the resilient force of the return spring into the second position, as indicated by the broken lines. In this position, the lever 8 engages with the stepped portion 4*d* of the high-speed rocker arm 4. As a result, the main rocker arm 2 swings about the main rocker shaft 3 in unison with the high-speed rocker arm 4. Since the high-speed cam 7 has such a profile as to provide a greater valve lift and a greater valve duration than the low-speed cams 5, the rollers provided for the main rocker arm 2 float from the respective low-speed cams 5 so that the movement of the low-speed cams 5 has no effect on the movement of the main rocker arm 2. Thus, the intake (or exhaust) valves V operate to open and close according to the profile of the high-speed cam 7.

When the engine speed changes from a value in the high speed range to a value in the low speed range, the control unit operates the change-over valve so as to decrease the pressure of the working oil introduced into the oil chamber 18. As a result, the plunger 17 returns to its first position, indicated by the solid lines of FIG. 1, to permit the lever 8 to return to its first position, indicated by the solid lines of FIG. 1, under the resilient force of the return spring. In the first position, the lever 8 comes out of engagement with the high-speed rocker arm 4 so as to permit the main rocker arm 2 independent of the movement of the high-speed rocker arm 4.

Since the lever 8 swings from the first position to the second position with its top end sliding on the inclined portion 4*e* of the high-speed rocker arm 4, the working oil pressure required for the swinging motion of the lever 8 is small. This is effective to reduce noise which would be produced when the main rocker arm 2 comes into collision with the respective low-speed cams 5.

Since the selection between the low and high-speed cams 5 and 7 is made by the engagement of the top end of the lever 8 with the stepped portion 4*e* of the high-speed rocker arm 4, it is possible to ensure stable engine valve operation without high machining accuracy.

Since the required degree of accuracy in the direction of height of the upper surfaces of the high-speed rocker arm 4 and the rollers provided for the main rocker arm 2 can be achieved merely by replacing the lever 8, it is possible to reduce the number of the processes required to manufacture the engine valve operating apparatus. This results in an inexpensive engine valve operating apparatus.

Since a recess 4*c* is formed in a compact high-speed rocker arm 4 for receipt of a lost motion mechanism 11, the engine valve operating apparatus is light. Since the lost motion spring 12 may be of the type having a weak resilient force, no means is required for limiting the stroke of movement of the spring retainer 13. This is effective to reduce the friction between the cam surface of the high-speed cam 7 and the cam slip surface 4*f* of the high-speed rocker arm 4.

The high-speed rocker arm 4 has a fundamental member made of cold draw steel including SKD11, SKD12 or SKD61. The fundamental member is shaped, through conventional cutting or precision casting techniques, as close to the shape of the high-speed rocker arm 4 as possible. After the shaped fundamental member is annealed if required, it is machined to have the shaft hole 4*a* formed for the sub rocker shaft 6, the recess 4*c* formed for the lost motion mechanism 11, the stepped portion 4*d* formed for engagement with the lever 8, and the cam slip surface 4*f* formed for sliding contact with the high-speed cam 7. The machined fundamental member is hardened to have a hardness of HRC60 or more and, then, finished with rough dimensions. Particularly, the roughness (Ra) required for the cam slip surface 4*f* to be processed later through physical vapor deposition (PVD) is 0.1 or less. After the completion of the PVD to deposit a hard coat of CrN or the like on the cam slip surface 4*f*, the cam slip surface 4*f* is polished to have a surface roughness (Ra) of 0.1 or less.

A series of tests were conducted to prove the effective combinations of the materials used for the high-speed rocker arm 4 to provide excellent persistence. The wear resistance and other characteristics of each test piece (high-speed rocker arm) were determined. For this purpose, the test piece was positioned in place in such an engine valve operating apparatus 1 as shown in FIG. 1 to operate the intake and exhaust valves of a four-cylinder engine having a cam shaft made of low-alloy chilled iron. The valve spring load was 30% stronger than specified by the standard specifications. An external electric motor was employed to drive the engine at 8000 rpm for 100 hours. The used engine oil was 7.5W-30SG and the engine oil temperature was 120° C.

Example 1—The high-speed rocker arm 4 (test piece) having a fundamental member made of cold draw steel SKD11 having a hardness of HRC61 just below the hard coat was shaped to have a minimum distance of 5 mm between the cam slip surface and the recess formed for receipt of the lost motion mechanism. CrN was deposited through PVD on the cam slip surface to form a hard coat having a thickness of 5.6 μm and a hardness of 1850 Hk (100 g). The amount of the deposited chrome carbide having a particle size ranging from 1 μm to 10 μm was in a range of 5% to 10%.

Example 2—The high-speed rocker arm 4 (test piece) having a fundamental member made of cold draw steel SKD12 having a hardness of HRC58 just below the hard coat was shaped to have a minimum distance of 5 mm between the cam slip surface and the recess formed for receipt of the lost motion mechanism. $Cr_2N$ was deposited through PVD on the cam slip surface to form a hard coat having a thickness of 5.2 μm and a hardness of 1720 Hk (100 g). The amount of the deposited chrome carbide having a particle size ranging from 1 μm to 10 μm was in a range of 5% to 10%.

Example 3—The high-speed rocker arm 4 (test piece) having a fundamental member made of cold draw steel SKD61 having a hardness of HRC55 just below the hard coat was shaped to have a minimum distance of 5 mm between the cam slip surface and the recess formed for receipt of the lost motion mechanism. TiN was deposited through PVD on the cam slip surface to form a hard coat having a thickness of 6.1 μm and a hardness of 2040 Hk (100 g). The amount of the deposited chrome carbide having a particle size ranging from 1 μm to 10 μm was in a range of 5% to 10%.

Example 4—The high-speed rocker arm 4 (test piece) having a fundamental member made of cold draw steel SKD11 having a hardness of HRC62 just below the hard coat was shaped to have a minimum distance of 5 mm between the cam slip surface and the recess formed for receipt of the lost motion mechanism. $Cr_2N$ was deposited through PVD on the cam slip surface to form a hard coat having a thickness of 2.4 μm and a hardness of 1510 Hk (100 g). The amount of the deposited chrome carbide having a particle size ranging from 1 μm to 10 μm was in a range of 5% to 10%.

Example 5—The high-speed rocker arm 4 (test piece) having a fundamental member made of cold draw steel SKD11 having a hardness of HRC59 just below the hard coat was shaped to have a minimum distance of 5 mm between the cam slip surface and the recess formed for receipt of the lost motion mechanism. $Cr_2N$ was deposited through PVD on the cam slip surface to form a hard coat having a thickness of 6.9 μm and a hardness of 1830 Hk (100 g). The amount of the deposited chrome carbide having a particle size ranging from 1 μm to 10 μm was in a range of 5% to 10%.

For comparison of the persistence obtainable by the invention, tests were conducted for the following comparative examples:

Example 6—The high-speed rocker arm 4 (test piece) having a fundamental member made of cold draw steel SKD11 having a hardness of HRC62 just below the hard coat was shaped to have a minimum distance of 5 mm between the cam slip surface and the recess formed for receipt of the lost motion mechanism. $Cr_2N$ was deposited through PVD on the cam slip surface to form a hard coat having a thickness of 1.3 μm and a hardness of 1440 Hk (100 g). The amount of the deposited chrome carbide having a particle size ranging from 1 μm to 10 μm was in a range of 5% to 10%.

Example 7—The high-speed rocker arm 4 (test piece) having a fundamental member made of cold draw steel SKD11 having a hardness of HRC57 just below the hard coat was shaped to have a minimum distance of 5 mm between the cam slip surface and the recess formed for receipt of the lost motion mechanism. $Cr_2N$ was deposited through PVD on the cam slip surface to form a hard coat having a thickness of 7.8 μm and a hardness of 1850 Hk (100 g). The amount of the deposited chrome carbide having a particle size ranging from 1 μm to 10 μm was in a range of 5% to 10%.

Example 8—The high-speed rocker arm 4 (test piece) having a fundamental member made of carbon tool steel SK1 having a hardness of HRC48 just below the hard coat was shaped to have a minimum distance of 5 mm between the cam slip surface and the recess formed for receipt of the lost motion mechanism. $Cr_2N$ was deposited through PVD on the cam slip surface to form a hard coat having a thickness of 5.1 μm and a hardness of 1730 Hk (100 g). The amount of the deposited chrome carbide having a particle size ranging from 1 μm to 10 μm was in a range of 5% to 10%.

Example 9—The high-speed rocker arm 4 (test piece) having a fundamental member made of low-alloy tool steel SKS1 having a hardness of HRC53 just below the hard coat was shaped to have a minimum distance of 5 mm between the cam slip surface and the recess formed for receipt of the lost motion mechanism. $Cr_2N$ was deposited through PVD on the cam slip surface to form a hard coat having a thickness of 5.0 μm and a hardness of 1700 Hk (100 g). The amount of the deposited chrome carbide having a particle size ranging from 1 μm to 10 μm was in a range of 5% to 10%.

For comparison of the persistence obtainable by the invention, tests were conducted further for the following prior art cases:

Example 10—A barrel chip made of ferrous sintered alloy containing 16% by weight of iron, 4% by weight of chrome and 2% by weight of carbon was prepared. The barrel chip was fitted in a frame formed on the high-speed rocker arm made of carburization steel SCM415 and, then, soldered with nickel alloy solder at 1050° C. in a vacuum furnace. Normally, direct acting type valve operating systems employ valve lifter shims made of carburization steel SCM415. Following this soldering process, the rocker arm was hardened to have a hardness of HRC60 since it was softened through the soldering process. The barrel chip had a thickness ranging from 1.5 mm to 3 mm and a hardness of HRC62. Gains existed in the soldered portion and the fundamental member. The minimum distance between the cam slip surface and the recess formed for receipt of the lost motion mechanism was 3 mm.

Example 11—A fundamental member made of carburization steel SCM415 was shaped as close to the shape of the high-speed rocker arm as possible. Following this, the fundamental member was machined to have the shaft hole 4*a* formed for the sub rocker shaft 6, the recess 4*c* formed for the lost motion mechanism 11, the stepped portion 4*d* formed for engagement with the lever 8, and the cam slip surface 4*f* formed for sliding contact with the high-speed cam 7. The minimum distance between the cam slip surface and the recess formed for receipt of the lost motion mechanism was 5 mm. The machined fundamental member is hardened to have a hardness of HRC61 and, then, finished with rough dimensions. The cam slip surface, which is a portion of the fundamental member made of SCM415, had a hardness of HRC60. There is substantially no carbide having a particle size grater than 1 μm.

The test results are illustrated in Table 1.

TABLE 1

Persistent Test Results

| | Wear Depth (μm) | | | | |
|---|---|---|---|---|---|
| Examples | Surface 4f | Step 4d | Cam 7 | Hard Coat Collapse | Hard Coat Separation |
| 1 | 2 or less | 3 | 4 | nil | nil |
| 2 | 2 or less | 3 | 3 | nil | nil |
| 3 | 2 or less | 5 | 12 | nil | nil |
| 4 | 2 or less | 4 | 5 | nil | nil |
| 5 | 2 or less | 3 | 4 | nil | nil |
| 6 | 15 | 4 | 18 | nil | worn |
| 7 | 37 | 5 | 25 | nil | separated |
| 8 | — | 13 | 9 | great | nil |
| 9 | 5 | 11 | 7 | small | nil |
| 10 | 2 or less | 5 | 6 | — | — |
| 11 | 55 | 38 | 8 | — | — |

As can be seen from the above table, for Examples 1 to 5 prepared according to the invention, both of the step portion 4*d* and the cam slip surface 4*f* were subject to wear (maximum wear depth) less than 5 μm. No scuff was found on the surface of the step portion 4*d* for engagement with the upper end of the lever 8 and also on the cam slip surface 4*f* for sliding contact with the high-speed cam 7. The hard coat formed on the cam slip surface 42 were subject to no collapse and no separation. The mating high-speed cam 7 held in sliding contact with the cam slip surface 4*f* was subject to wear (maximum wear depth) less than 5 μm except for Example 3. No sever scuff was found on the contact surface of the high-speed cam 7.

For the first comparative example, Example 6, the hard coat had a thickness as thin as 2 μm. For this reason, the hard coat was worn to such an extent that the fundamental member is exposed in places with scuffs found on the cam slip surface 4*f*. The mating high-speed cam 7 was subject to a great degree of wear. Because of such a great degree of wear, the valve operating apparatus cannot be used further.

For the second comparative example, Example 7, the hard coat had a thickness greater than 7 μm. For this reason, the adhesive strength between the fundamental member and the hard coat is low. It was found after the persistent test that the hard coat was separated along the interface between the hard coat and the fundamental member. The mating high-speed cam 7 was subject to a great degree of wear. Because of such a great degree of wear, the valve operating apparatus cannot be used further.

For the third comparative example, Example 8, the fundamental member made of carbon tool steel SK1 was softened to a great extent (much less than HRC55) at a position below the hard coat due to a great temperature increase made during the PVD. The fundamental member was dented to such a great extent that the valve operating apparatus cannot be used further.

For the fourth comparative example, Example 9, the fundamental member made of low-alloy tool steel SKS1 was softened to a great extent (much less than HRC55) at a position below the bar coat during the PVD. The fundamental member was dented to such a great extent (less than found in Example 8) that the valve operating apparatus cannot be used further.

It can be seen from the test results that the hard coat should have a thickness ranging from 2 μm to 7 μm and the fundamental member should have a hardness greater than HRC55 just below the hard coat. The fundamental member may be made of high-speed tool steel SKH which exhibits a greater softening resistance than draw steel SKD and deposits a great number of carbide.

For the first prior art case, Example 10, the barrel chip made of ferrous sintered alloy was fixed in a frame on the fundamental member and soldered to the fundamental member. The fundamental member was cut for the solder to decrease the minimum thickness between the recess 4*c* and the cam slop surface 4*f* and also formed with an undercut required in machining the frame. The valve operating apparatus cannot be used further because of fatigue cranking produced at positions where the fundamental member has its thickness decreased.

For the second prior art case, Example 11, no carbide having a particle size of 1 μm or more was deposited. For this reason, the high-speed rocker arm exhibited poor wear resistance. The cam slip surface 4*f* held in engagement with the high-speed cam 7 and the step portion 4*d* for engagement with the upper end of the lever 8 were subject to such a great degree of wear that the valve operating apparatus cannot be used further.

What is claimed is:

1. A valve operating apparatus for use with an internal combustion engine including at least one cylinder having at least one intake valve and at least one exhaust valve, and a camshaft rotatable in synchronism with rotation of the engine, comprising:

a high-speed cam mounted on the camshaft for rotation in unison with the camshaft;

a low-speed cam mounted on the camshaft for rotation in unison with the camshaft;

a main rocker arm supported for swinging motion to operate one of the intake and exhaust valves;

a high-speed rocker arm having a slip surface for engagement with the high-speed cam, the high-speed rocker arm being supported on the main rocker arm for swinging motion according to rotation of the high-speed cam;

means for making a driving connection of the high-speed rocker arm to the main rocker arm for swinging motion of the main rocker arm in unison with the high-speed rocker arm when the engine is operating at a high speed;

means for interrupting the driving connection of the high-speed rocker arm to the main rocker arm to permit swinging motion of the main rocker arm according to rotation of the low-speed cam independently of the swinging motion of the high-speed rocker arm when the engine is operating at a low speed;

the slip surface of the high-speed rocker arm being made of an alloy tool steel having carbide deposited and dispersed to provide a hardness of HRC55 or more to the slip surface; and a hard coat formed, through physical vapor deposition, on the slip surface of the high-speed rocker arm.

2. The valve operating apparatus as claimed in claim 1, wherein the means for interrupting the driving connection of the high-speed rocker arm to the main rocker arm includes a lost motion mechanism placed in the high-speed rocker arm for lost motion of the high-speed rocker arm when the engine is operating at a low speed.

3. The valve operating apparatus as claimed in claim 2, wherein at least one of CrN, $Cr_2N$ and TiN is deposited, through physical vapor deposition, to form the hard coat having a thickness ranging from 2 μm to 7 μm and a Vickers Knoop hardness greater than Hk1500.

4. The valve operating apparatus as claimed in claim 2, wherein the alloy tool steel is one of draw steel SKD and high-speed tool steel SKH.

5. The valve operating apparatus as claimed in claim 4, wherein at least one of CrN, $Cr_2N$ and TiN is deposited, through physical vapor deposition, to form the hard coat having a thickness ranging from 2 μm to 7 μm and a Vickers Knoop hardness greater than Hk1500.

6. The valve operating apparatus as claimed in claim 1, wherein the alloy tool steel is one of draw steel SKD and high-speed tool steel SKH.

7. The valve operating apparatus as claimed in claim 6, wherein at least one of CrN, $Cr_2N$ and TiN is deposited, through physical vapor deposition, to form the hard coat having a thickness ranging from 2 μm to 7 μm and a Vickers Knoop hardness greater than Hk1500.

* * * * *